US011969644B2

(12) United States Patent
Byrne

(10) Patent No.: US 11,969,644 B2
(45) **Date of Patent: *Apr. 30, 2024**

(54) CHILDREN'S COOPERATIVE EDUTAINMENT BOARD GAME

(71) Applicant: Jennifer Rachel Byrne, Silver Spring, MD (US)

(72) Inventor: Jennifer Rachel Byrne, Silver Spring, MD (US)

(73) Assignee: Jennifer Rachel Byrne, Silver Spring, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/729,315

(22) Filed: Apr. 26, 2022

(65) Prior Publication Data

US 2024/0066386 A1 Feb. 29, 2024

Related U.S. Application Data

(63) Continuation of application No. 16/989,358, filed on Aug. 10, 2020, now Pat. No. 11,351,441.

(51) Int. Cl.

| | |
|---|---|
| ***A63F 1/04*** | (2006.01) |
| ***A63F 3/00*** | (2006.01) |
| ***A63F 3/04*** | (2006.01) |

(52) U.S. Cl.

CPC ..... *A63F 1/04* (2013.01); *A63F 3/00063* (2013.01); *A63F 3/04* (2013.01); *A63F 2001/0441* (2013.01)

(58) Field of Classification Search

CPC ..... A63F 1/04; A63F 3/00063; A63F 3/04; A63F 2001/0441; A63F 3/0449; A63F 3/0434; G09B 19/00; G09B 7/00

See application file for complete search history.

(56) References Cited

U.S. PATENT DOCUMENTS

| | | | | |
|---|---|---|---|---|
| 4,076,249 A * | 2/1978 | Sneathen, Jr. | ..... | A63F 3/00072 273/256 |
| 5,123,846 A * | 6/1992 | Lewis | ..... | A63F 3/0434 434/150 |
| 5,207,792 A * | 5/1993 | Anderson | ..... | A63F 3/00072 273/256 |

(Continued)

*Primary Examiner* — Michael D Dennis

(74) *Attorney, Agent, or Firm* — Raj S. Dave; Dave Law Group LLC

(57) ABSTRACT

A cooperative board game played by a group of players includes a customizable playhouse, a game board having a plurality of defined areas each defined by a shape on the game board, a plurality of activities including Level 1, Level 2, Level 3, and Level 4 activities, wherein each level corresponds to one of the defined areas, a plurality of decks of dramatic play cards, wherein each of the plurality of decks corresponds to one of the levels, and an online map that can be accessed after completing a final activity in Level 4. Each player in the group of players completes each of the Level 1, Level 2, Level 3, and Level 4 activities in order, wherein the game is complete after each player completes the Level 4 final activity. The unique value propositions include self-discovery, a bird's eye view of the world, flexible and repeatable activities for endless outcomes, and an online community providing hindsight learning and real-world connection with others.

20 Claims, 14 Drawing Sheets

(56) References Cited

U.S. PATENT DOCUMENTS

| | | | | | |
|---|---|---|---|---|---|
| 5,288,075 | A * | 2/1994 | Kelley | A63F 9/1011 | D21/392 |
| 5,743,529 | A * | 4/1998 | Haynes | A63F 3/0457 | 434/107 |
| 5,810,666 | A * | 9/1998 | Mero | A63F 3/08 | 463/16 |
| 6,053,792 | A * | 4/2000 | Sallee | A63H 33/30 | 434/245 |
| 6,135,451 | A * | 10/2000 | Kholodov | A63F 3/0457 | 273/242 |
| 9,186,572 | B2 * | 11/2015 | Baker | A63F 3/0434 | |
| 2003/0094758 | A1 * | 5/2003 | Hardie | A63F 3/00063 | 273/254 |
| 2003/0137106 | A1 * | 7/2003 | Pavlovits | A63H 33/008 | 273/157 R |
| 2004/0212149 | A1 * | 10/2004 | Farmer | A63F 3/0478 | 273/242 |
| 2007/0018393 | A1 * | 1/2007 | Ritter | A63F 9/183 | 273/272 |
| 2009/0061729 | A1 * | 3/2009 | Boerman | A63H 3/52 | 434/81 |
| 2009/0104838 | A1 * | 4/2009 | Manrique | A63H 33/38 | 446/108 |
| 2015/0290531 | A1 * | 10/2015 | Herz | A63F 3/00088 | 434/237 |
| 2017/0246546 | A1 * | 8/2017 | Brown, Sr. | A63H 3/02 | |
| 2018/0025661 | A1 * | 1/2018 | More | G09B 25/06 | 434/130 |
| 2018/0272229 | A1 * | 9/2018 | Tunny | A63F 3/00088 | |
| 2019/0099659 | A1 * | 4/2019 | Ghingold | A63F 3/00075 | |
| 2019/0308091 | A1 * | 10/2019 | Pestano | A63F 3/00697 | |
| 2020/0261788 | A1 * | 8/2020 | Hammer | A63F 1/04 | |

* cited by examiner

115

CHILDREN'S COOPERATIVE EDUTAINMENT BOARD GAME

CROSS-REFERENCE TO RELATED APPLICATIONS

This application is the continuation of U.S. patent application Ser. No. 16/989,358, filed on Aug. 10, 2020, the entire disclosure of which is incorporated herein by reference as part of the disclosure of this application.

BACKGROUND

Making learning fun for children is a difficult task, and the children's edutainment industry has been expanding rapidly to try to solve this problem. Education and entertainment often intersect, and when they do, it can create memorable and meaningful learning. For example, while traditional education can be important and effective, it often loses the attention of students, and particularly children. In contrast, edutainment can provide the same information in a fun and interactive style to maintain interest in the curriculum while also promoting more social and emotional experiences that traditional education often lacks.

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

SUMMARY

According to aspects of the disclosed subject matter, a cooperative board game played by a group of players includes a customizable playhouse, a game board having a plurality of defined areas each defined by a shape on the game board, a plurality of activities including Level 1, Level 2, Level 3, and Level 4 activities, wherein each level corresponds to one of the defined areas, a plurality of decks of dramatic play cards, wherein each of the plurality of decks corresponds to one of the levels, and an online map that can be accessed after completing a final activity in Level 4. Each player in the group of players completes each of the Level 1, Level 2, Level 3, and Level 4 activities in order, wherein the game is complete after each player completes the Level 4 final activity. The unique value propositions include self-discovery, a bird's eye view of the world, flexible and repeatable activities for endless outcomes, and an online community providing hindsight learning and real-world connection with others.

According to one aspect of the disclosed subject matter, each of the first, second, third, and fourth shapes are circles.

Additionally, the Level 1 halfway point activity includes each player placing a business card in the first area of the game board, the Level 2 halfway point activity includes each player placing a street sign in the second area of the game board, the Level 3 halfway point activity includes each player placing a foldable cardboard replica business in the third area of the game board, wherein placing the replica business in the third area of the game board corresponds to placing each of the foldable cardboard replica businesses around a perimeter of the of the third area of the game board, and wherein the Level 4 halfway point activity includes each player placing art in the fourth area of the game board.

According to one aspect of the disclosed subject matter, the customizable playhouse includes interchangeable components, wherein the components used to customize the playhouse correspond to gameplay of the game.

According to one aspect of the disclosed subject matter, the game includes a mailbox, wherein the mailbox includes the unique address of the virtual lot on the virtual street.

According to one aspect of the disclosed subject matter, the game includes an editable sign.

According to one aspect of the disclosed subject matter, the predetermined number of activities in each set is ten activities.

According to one aspect of the disclosed subject matter, the first set of activities includes activities that guide each player to describe personal traits, the second set of activities includes activities that guide each player to describe a business, wherein the described business is based at least in part on one or more outcomes of each player's first set of activities, respectively, the third set of activities includes activities that guide each player to build a community, and the fourth set of activities includes activities that guide each player to analyze a collective community the group of players built.

The foregoing paragraphs have been provided by way of general introduction and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1A:
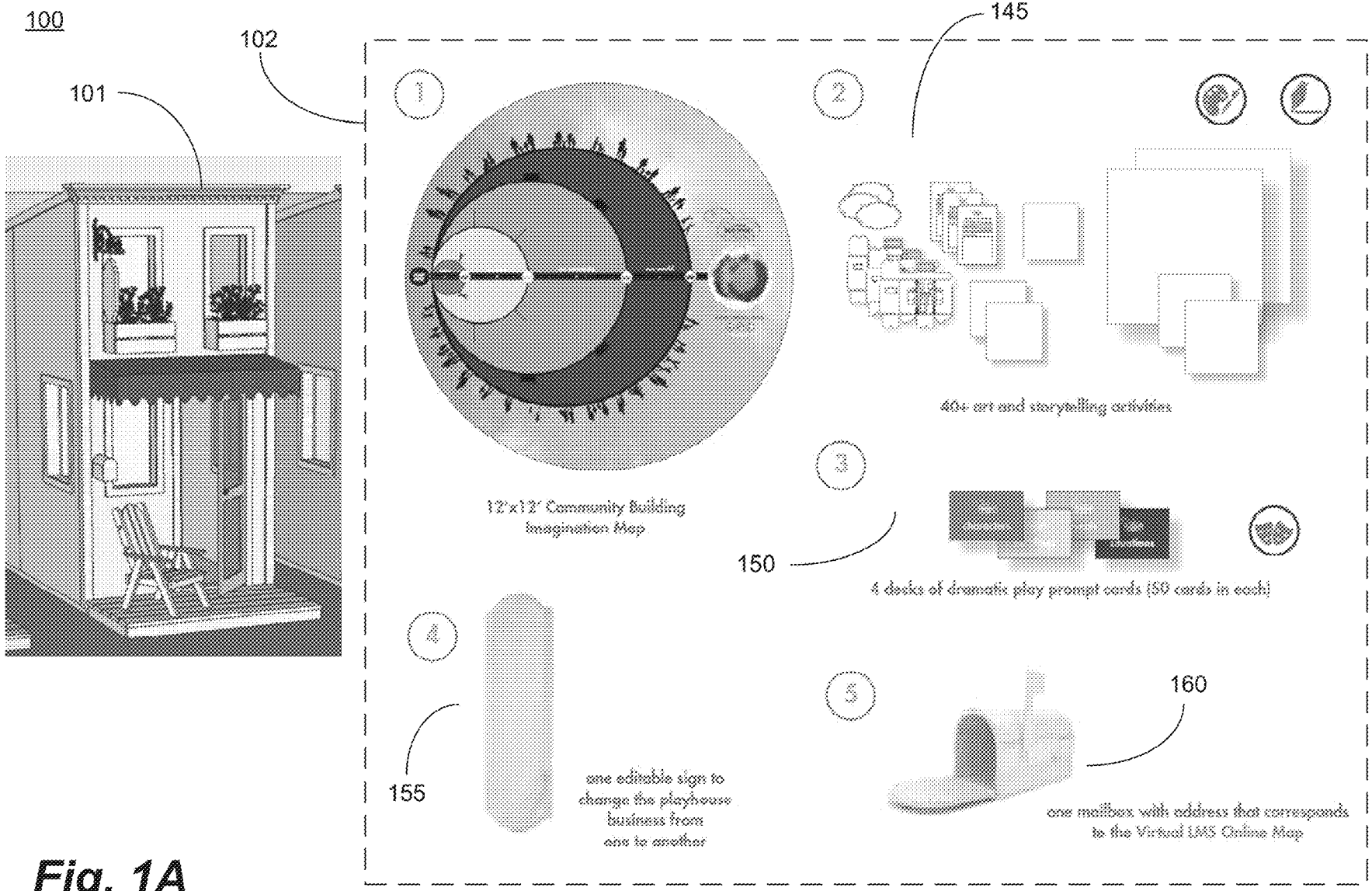
FIG. 1A illustrates an exemplary cooperative children's edutainment board game according to one or more aspects of the disclosed subject matter.

The description set forth below in connection with the appended drawings is intended as a description of various embodiments of the disclosed subject matter and is not necessarily intended to represent the only embodiment(s). In certain instances, the description includes specific details for the purpose of providing an understanding of the disclosed subject matter. However, it will be apparent to those skilled in the art that embodiments may be practiced without these specific details. In some instances, well-known structures and components may be shown in block diagram form in order to avoid obscuring the concepts of the disclosed subject matter.

Reference throughout the specification to "one embodiment" or "an embodiment" means that a particular feature, structure, characteristic, operation, or function described in connection with an embodiment is included in at least one embodiment of the disclosed subject matter. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments. Further, it is intended that embodiments of the disclosed subject matter can and do cover modifications and variations of the described embodiments.

It must be noted that, as used in the specification and the appended claims, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the disclosed subject matter to any particular orientation or configuration. Furthermore, terms such as "first," "second," "third," etc., merely identify one of a number of portions, components, points of reference, operations and/or functions as described herein, and likewise do not necessarily limit embodiments of the disclosed subject matter to any particular configuration or orientation.

Generally, the cooperative children's edutainment board game (also referred to herein as board game and/or game) described herein brings dramatic play, visual art, and storytelling together for a full interactive experience. Increasing numbers of studies are showing how experiential learning is more effective than passive learning and introduces children to other ways of looking at the world through increased interaction with their peers. Additional studies on the benefits of emotional learning are also becoming widely accepted in the sense that feelings themselves facilitate better understanding and retention of information. Further, storytelling/art/dramatic play prompts all help dig deeper to core emotions. For example, the game can provide an environment for learning the concepts of identifying unique skillsets/qualities, how communities are built, and how we can most effectively engage with the world through working through challenging scenarios.

The board game can include one or more life-size playhouses, a story board map (e.g., game board), and a set of activities. In one aspect, the board game encourages self-discovery and connection between the children playing the board game. The game board and activities can serve as a tool by which those playing the game can both physically interact with the playhouses, game board, and other game pieces further described herein, and also imagine what they want to see in their own world and learn to see things from other perspectives. The game board is created so that the students start with themselves and move to the street, the community, and ultimately, the world. Interaction between their ideas and the playhouse is part of the benefit of using real and imagined tools to learn and make connections in tangible ways from the inside out.

The game can be suitable for children as an addition to traditional school curriculum and can be played while at school. For example, the game provides a loose guideline to weave in and out of what is being taught for added value and engagement. Simultaneously, the game is open ended enough for endless customization between the individual's teaching style, content, local community playhouse funding, and the game is in both real (classroom) and imagined (child's imagination/virtually) spaces to create an overall feeling of possibility for children at the very age they are open to anything. For example, studies show that by age 7 or 8 children have largely formed their views of themselves and the world. The significance of play-based learning has been cited by eminent scholars over the last century (e.g., Erikson, Freud, Piaget) in cognitive, social, and emotional development.

Additionally, the phases of the game and the steps for each phase can be played throughout the school year so that the game begins around the beginning of the school year and ends around the end of the school year. It should be appreciated that the game can be played in shorter or longer time frames based on the amount of time spent on each step within a phase. For example, the length of the game can be adapted to be as short or as long as needed for a desired learning experience. Additionally, it should be appreciated that the game can be played outside of school. For example, the game can be played anywhere that a playhouse, the game board, the one or more additional game pieces, and one or more children are located (e.g., community center, childcare facility, camp, etc.).

Referring now to the drawings, wherein like reference numerals designate identical or corresponding parts throughout the several views:

FIG. 1A illustrates an exemplary cooperative children's edutainment board game 100 (herein also referred to as board game 100 and/or game 100) according to one or more aspects of the disclosed subject matter. For example, the board game 100 includes at least one life-size playhouse 101 and an imagination kit 102. The playhouse 101 can represent one or more playhouses of the same or varying sizes. In one aspect, the imagination kit can come with the purchase of a life-size playhouse (e.g., playhouse 101). The imagination kit 102 can include a game board 103, art and storytelling activities 145, a plurality of decks of dramatic play cards 150, a sign 155 for the playhouse 101, and a mailbox 160 for the playhouse 101. Each of these components of the board game 100 will be described herein in more detail.

The imagination kit 102 can be used in conjunction with one or more life-size playhouse(s) 101. The imagination kit 102 can also provide teachers with a flexible, engaging, and experiential way to take the lessons they are already teaching through the core curriculum material further at their own pace up to an entire school year. The kit provides a loose structure, process, and tools by which children can explore the concepts of self-discovery and connection with others together as a class. The game board 103 can serve as a connecting element of the materials provided (e.g., writing/drawing/interactive activities). The children can also place their creations on the various levels of the game board 103, as well as draw cards at each level that prompt dramatic play interaction with the playhouse 101. Progression from one level to the next is by way of "trying on" another's perspective. The ultimate goal being for them to begin conceptualizing how one person can affect the whole world one step at a time through understanding and empathy.

More specifically, the children move through a series of 4 levels starting within and moving outward to the world at large. Each level can contain numbered activities to be completed in order. The final destination is an online community represented as an online map including a virtual street (e.g., a fictional street lined by a plurality of houses where each of the plurality of houses corresponds to a digital representation of a playhouse that was purchased) where the class can share stories/photos from the year with other end users of the game 100 around the world in real time. The lines from imagination to reality become blurred because they are interacting with real people on an imaginary street where proximity is completely made up. In other words, a playhouse/town can be virtually next to someone that is physically across the country.

Figure 1B:
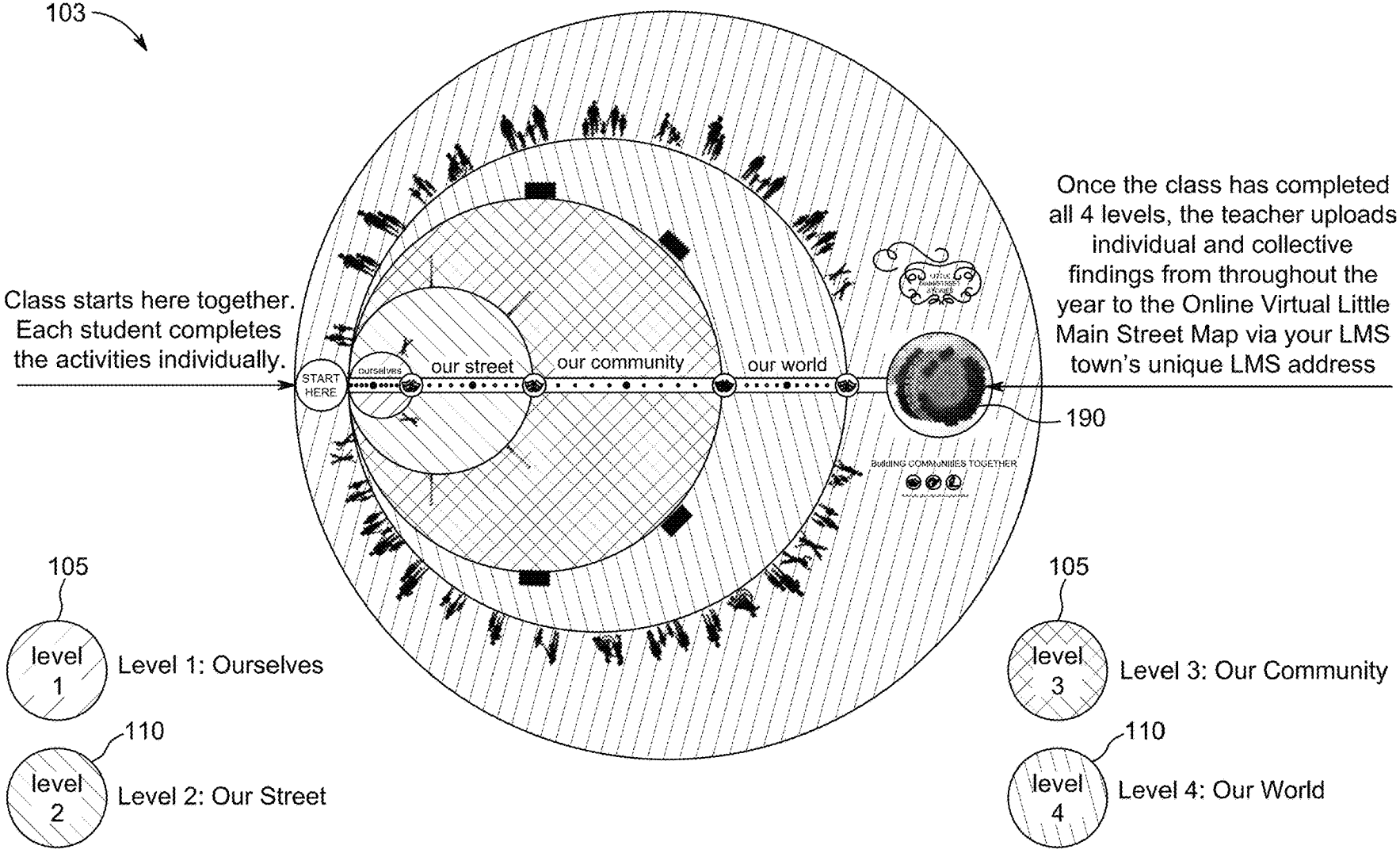
FIG. 1B illustrates an exemplary game board for the cooperative children's edutainment board game according to one or more aspects of the disclosed subject matter.
Figure 2:
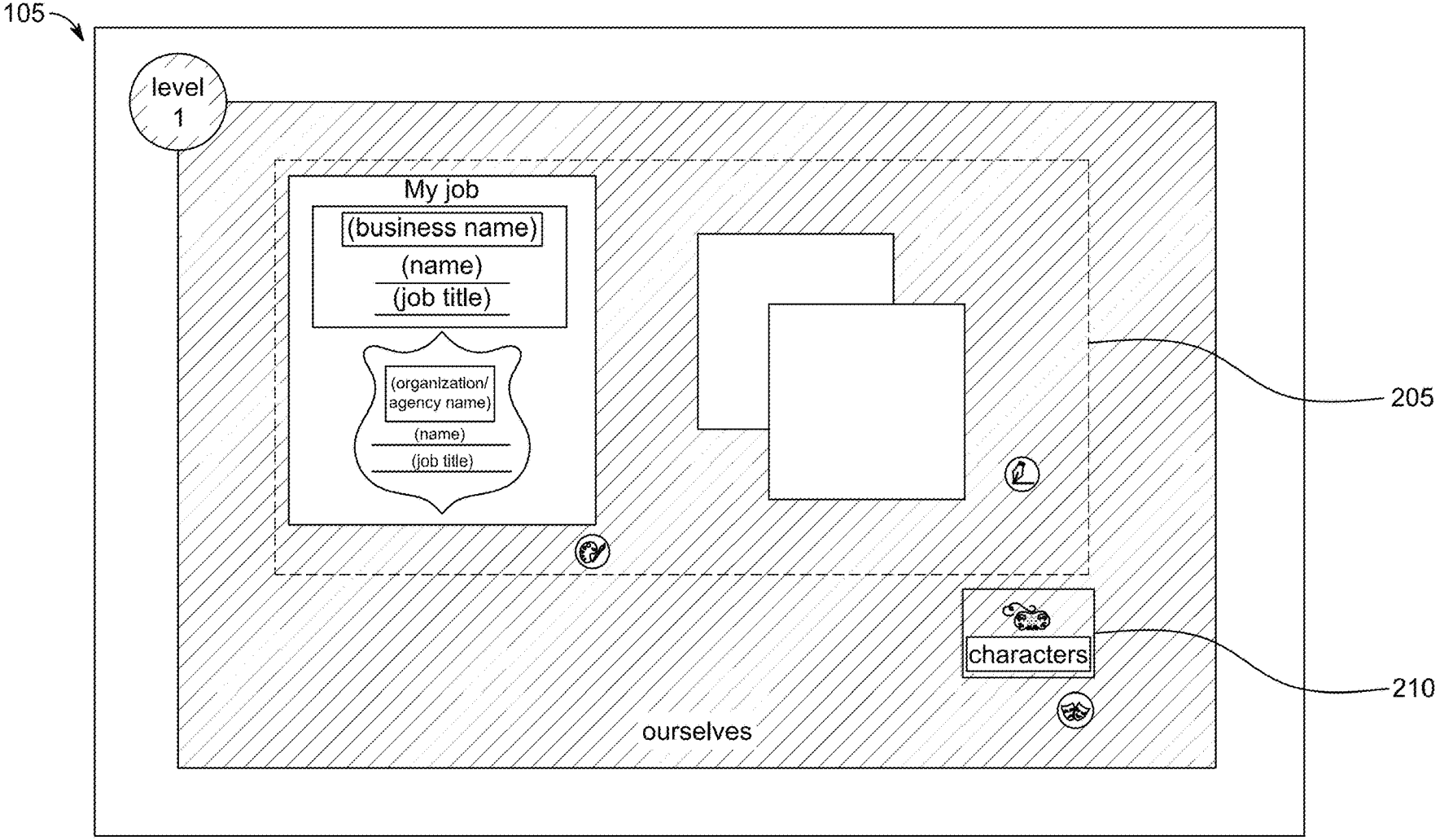
FIG. 2 illustrates a first area for housing Level 1 activities and/or dramatic play cards according to one or more aspects of the disclosed subject matter.
Figure 3:
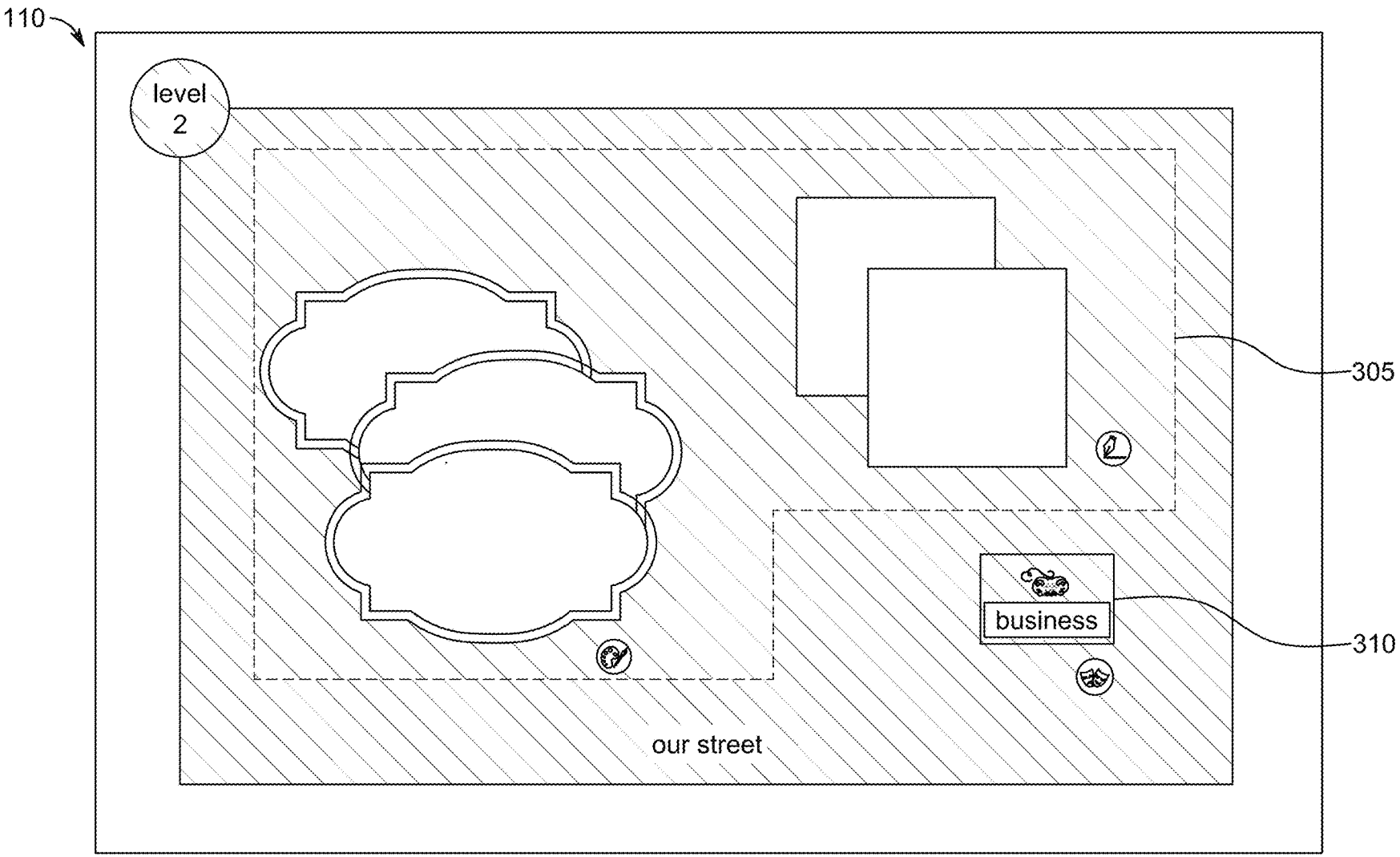
FIG. 3 illustrates a second area for housing Level 2 activities and/or dramatic play cards according to one or more aspects of the disclosed subject matter.
Figure 4:
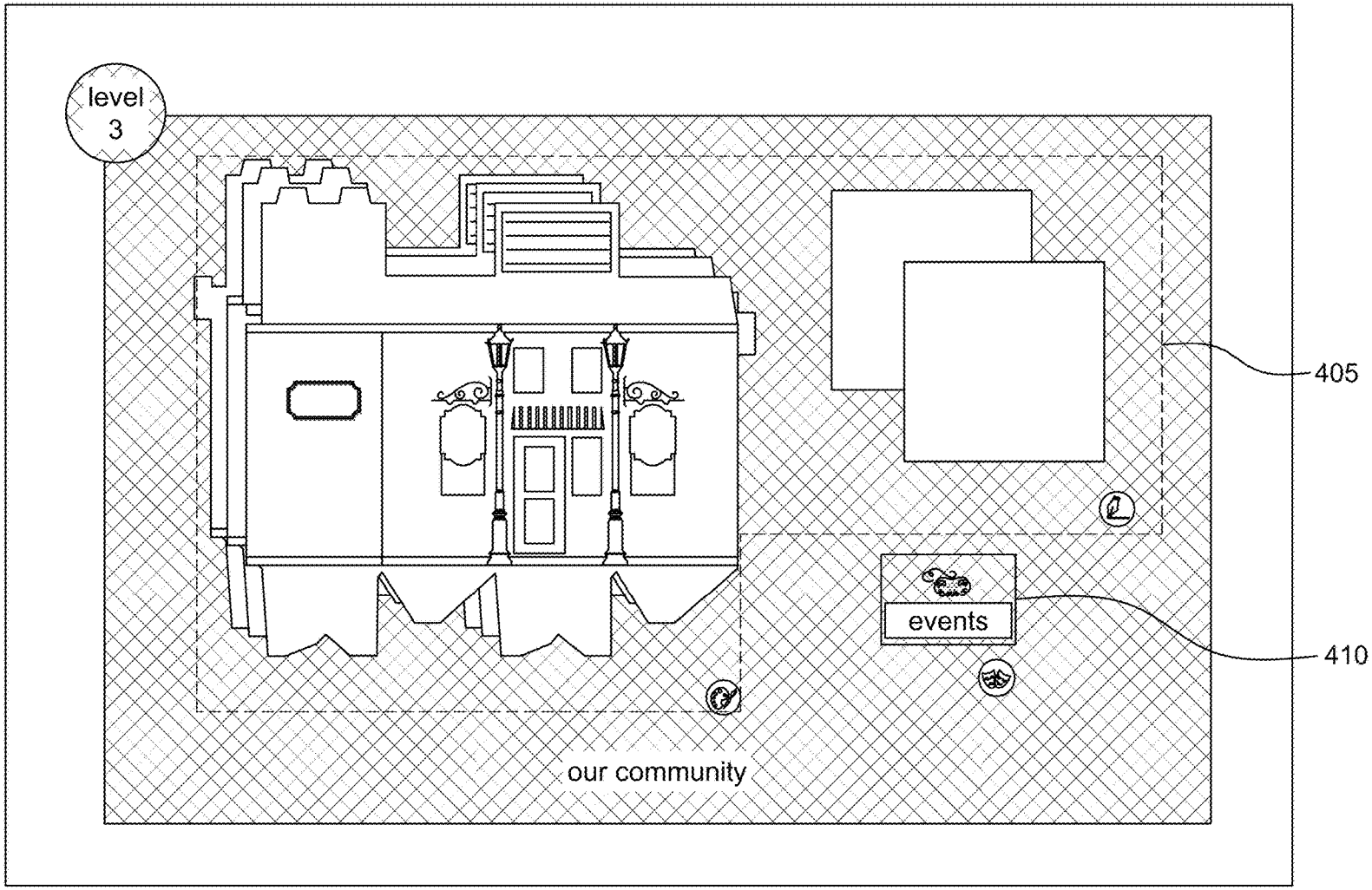
FIG. 4 illustrates a third area for housing Level 3 activities and/or dramatic play cards according to one or more aspects of the disclosed subject matter.

FIG. 1B illustrates an exemplary game board 103 for the cooperative children's edutainment board game 100 according to one or more aspects of the disclosed subject matter. The game board 103 can include spaces for different activities (e.g., art and storytelling activities 145) and different types of cards (e.g., the plurality of decks of dramatic play cards 150) to be drawn during the game. It should be appreciated that the art and storytelling activities 145 can include Level 1 activities 205, Level 2 activities 305, Level 3 activities 305, and Level 4 activities 405 as shown in FIGS. 2-4, respectively. Similarly, the plurality of decks of dramatic play cards 150 can include Level 1 character dramatic play cards 210, Level 2 business dramatic play cards 310, Level 3 event dramatic play cards 410, and Level 4 situation dramatic play cards 410 as shown in FIGS. 2-4, respectively. The game board 103, the activities 145, and the dramatic play cards 150 can serve as a connecting tool used in the physical play space where the at least one playhouse 101 is the backdrop. In one aspect, children can sit around the perimeter of the game board 103 to do the activities as some activities involve physical interaction with the game board 103, as well as inspire group discussion with a goal being to help children (e.g., ages 3-8 years old) to identify how one person's unique qualities can affect others around them, and, in turn, how one person's unique qualities can affect the world.

In one aspect, the game board 103 can be large to accommodate the children sitting around the perimeter. In a non-limiting example for the description of the game board, the game board 103 can have a diameter of 12 feet. The game board 103 can include a set of shapes (e.g., circles) defining predetermined areas on the game board 103. The predetermined areas can start with the individual (e.g., Level 1) and move outward to the street (e.g., Level 2), the community (e.g., Level 3), and finally the world (Level 4). The student or group of students can move through a set of activities together at a pace that works for their curriculum (e.g., up to a full school year). The class as a group can only move from one level to the next after they have completed all art and/or storytelling activities in addition to "playing" dramatic play interactive cards associated with that level. For example, there can be 9 art and/or storytelling activities to work through before playing the dramatic play interactive cards for that level.

In one aspect, the activities can involve personal reflection and can be done independently by way of art and/or storytelling worksheets which are housed on predetermined areas of the game board 103. For example, there can be four predetermined areas each housing at least the art and storytelling activities 145 corresponding to that area. Additionally, each area can be color coded based on the corresponding level. The game board 103 can include a first area 105 corresponding to Level 1. The game board 103 can include a second area 110 corresponding to Level 2. The game board 103 can include a third area 115 corresponding to Level 3. The game board 103 can include a fourth area 120 corresponding to Level 4. The final activity in each level can include an interaction with the life-size playhouse (e.g., the playhouse 101) takes place and is a prompt for trying on another perspective by way of randomly selecting a card from one of four sets of card decks, where each card deck corresponds to one of Levels 1-4. For example, the child can select a character card (Level 1), a business card (Level 2), an event card (Level 3), or a situation card (Level 4) depending on which level they are on. Selection of a card prompts role play in and/or around the one or more playhouses based on the text of the card. In one aspect, the customizable sign can be set to the scene of the playhouse. For example, the customizable sign can be a chalkboard that can be reused for different players, different playhouses, and/or different iterations of the game (e.g., a new game the following school year).

In one aspect, a goal of the game (e.g., in the context of an ongoing school year activity) can be to provide an interactive tool an instructor can use as a tie in to existing curriculum, as applicable, providing an experiential element that connects concepts from micro to macro. In other words, the cooperative children's edutainment board game can encourage children to see how individuals, streets, communities, and the world comes together and identify what works and what doesn't by considering new ways of interacting with themselves and others. Additionally, after finishing the game, the address that came with the playhouse can correspond to a deed to a lot in a virtual community map that can be accessed. The deed to the lot in the virtual community map can correspond to a location on a street that stretches "around the world" so that the children can connect to other participants (e.g., other groups of children that played the game). As a result, lots "belonging" to groups of children from different towns, states, and even countries, can appear as next-door neighbors on a virtual street. The lines from real to imaged are blurred purposely to create a sense of everything being possible. Therefore, the game provides an opportunity for the children to think outside the box for a better and more connected world.

FIG. 2 illustrates a first area (e.g., the first area 105) for housing Level 1 activities and/or dramatic play cards according to one or more aspects of the disclosed subject matter. The first area 105 can include Level 1 activities 205 and character dramatic play cards 210. More specifically, the Level 1 activities 205 focus on the children looking within to discover themselves to identify special qualities, for example. By recognizing feelings and values, what they love to do, and who they choose to spend time with, the children can learn about the foundation for the steps that come next in Levels 2, 3, and 4. The final activity in Level 1 involves randomly choosing a character dramatic play card 210 from a plurality of character dramatic play cards (e.g., deck of character cards). The card can include a persona and the child can explore how a person who fits that persona might be, act, and/or do things differently than how the child who drew the card would do it. Additionally, in one aspect, the players of the game cannot move to Level 2 until completing this final activity of Level 1.

FIG. 3 illustrates a second area (e.g., the second area 110) for housing Level 2 activities and/or dramatic play cards according to one or more aspects of the disclosed subject matter. The second area 110 can include Level 2 activities 305 and business dramatic play cards 310. More specifically, the Level 2 activities focus on taking what the children learned in Level 1 and applying it to job roles and in businesses that might suit them, thus exploring what functions are provided by certain jobs and how they can serve others. Then, the children can imagine how their businesses may look on their street and the range of services offered from their neighbors. The final activity in Level 2 corresponds to choosing a random business dramatic play card 310 and exploring how different this other business is between products, services, setup, customers, employee qualities, etc. Additionally, in one aspect, the players of the game cannot move to Level 3 until completing this final activity of Level 2.

FIG. 4 illustrates a third area (e.g., the third area 115) for housing Level 3 activities and/or dramatic play cards according to one or more aspects of the disclosed subject matter. The third area 115 can include Level 3 activities 405 and event dramatic play cards 410. More specifically, Level 3 activities can focus on placement and interaction. For example, the children can learn how jobs and proximity to one another can affect each other. Further, Level 3 can promote consideration of building of the town, how the flow of the town works, and what other buildings, green spaces, etc. might enhance the community environment. In one aspect, the Level 3 activities 405 can include foldable playhouses that can be additional pieces of the game. The foldable playhouses can be cardboard (or another similar material) that can be folded into a small building (e.g., cuboid with features of a building drawn on at least one face of the cuboid) as further described herein (e.g., matching customizable mini playhouse replicas 1215 in FIG. 12). For example, each of the children can fold a small playhouse which can be placed on the game board 103 to show a physical representation of building of the town, the flow, the placement and interaction of buildings having different purposes, and the like. The final activity in Level 3 corresponds to choosing a random event dramatic play card 410 and exploring how an event that happens in the community might affect the community collectively and as individual businesses. Additionally, in one aspect, the players of the game cannot move to Level 3 until completing this final activity of Level 2.

Figure 5:
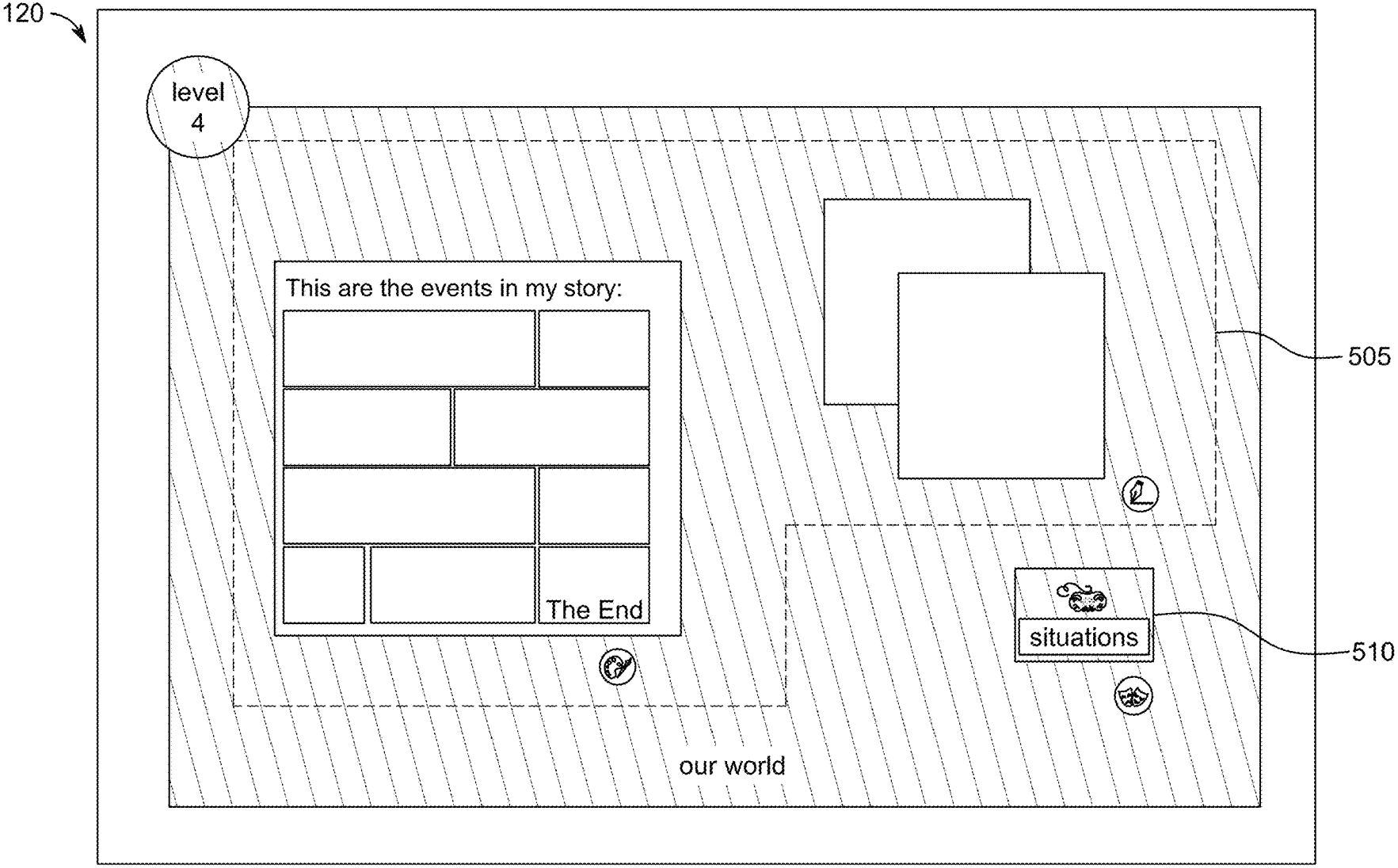
FIG. 5 illustrates a fourth area for housing Level 4 activities and/or dramatic play cards according to one or more aspects of the disclosed subject matter.

FIG. 5 illustrates a fourth area (e.g., the fourth area 120) for housing Level 4 activities and/or dramatic play cards according to one or more aspects of the disclosed subject matter. The fourth area 120 can include Level 4 activities 505 and situation dramatic play cards 510. More specifically, Level 4 activities can focus on reflecting on the community that the children built together as a group (e.g., as a class) and consider what they liked and what they would like to see differently. For example, they can identify what worked, the challenges, and wonder if/how/what they might do differently next time to produce a better outcome for everyone in the community. They might consider how the community could be better and how they individually could be better within the community. The final activity in Level 4 can correspond to choosing a random situation dramatic play card 510 and explore how a situation/scenario that happens in the world might affect the people and communities as a result. Additionally, in one aspect, after finishing the final activity in Level 4, the game (or at least one round of the game) is complete. In one aspect, completing the final activity in Level 4 may indicate that one round of a longer game is complete as the levels can be played again, just Level 4 can be played again, etc. Additionally, it should be appreciated that one or more steps and/or the final activity for each level can be repeated before moving on at the instructor's discretion. Because each deck of the dramatic play cards includes many different cards and because the cards are drawn randomly, more than one character, business, event, and situation, respectively, can be considered before moving on to the next level.

Figure 6:
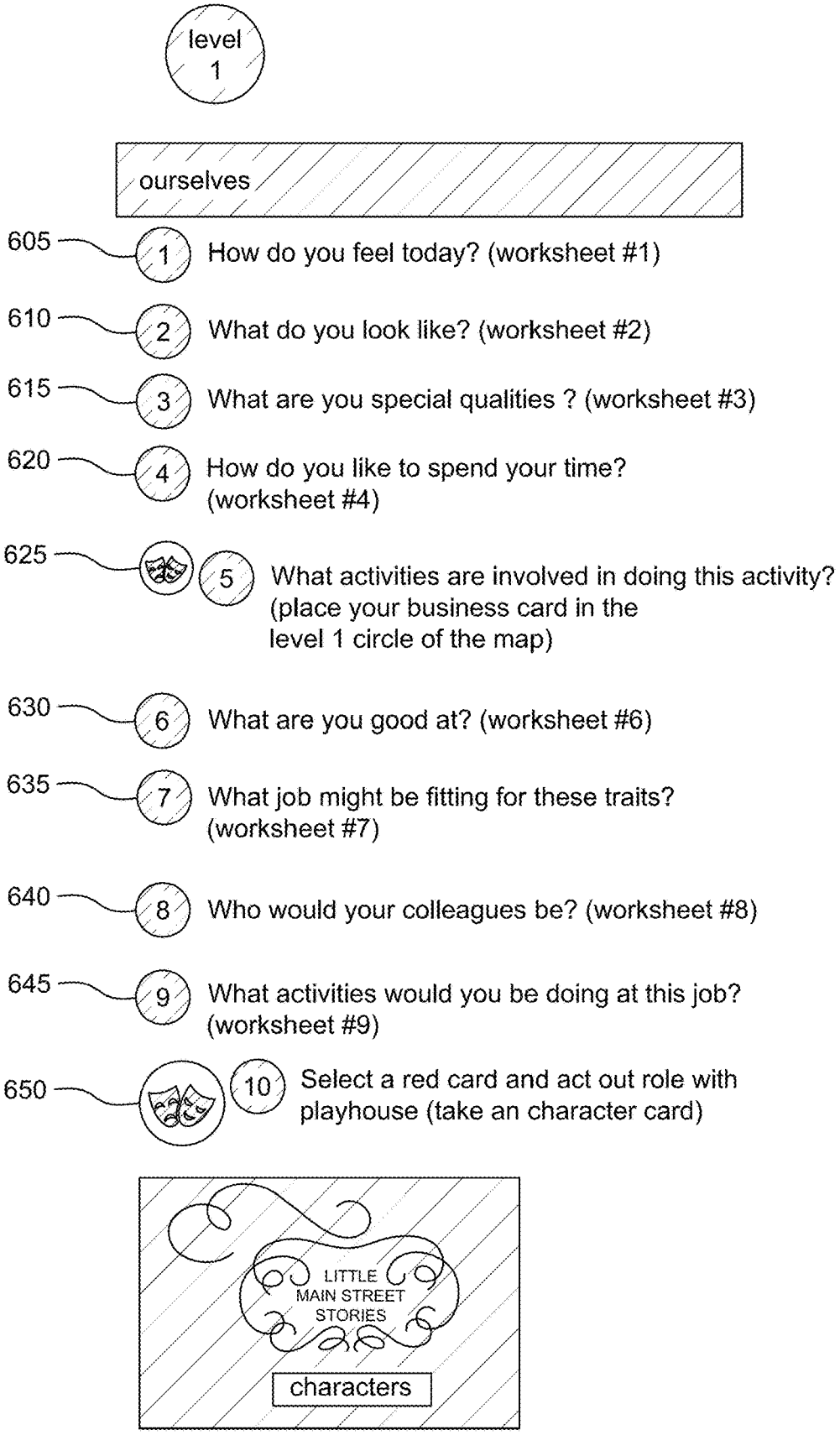
FIG. 6 illustrates exemplary steps to complete Level 1 of the game according to one or more aspects of the disclosed subject matter.

FIG. 6 illustrates exemplary steps to complete Level 1 of the game according to one or more aspects of the disclosed subject matter. For example, each of the steps can correspond to different activities. Additionally, there can be at least two special activities—one including an interaction with the game board 103, and one including an interaction with the playhouse 101. In one aspect, the interaction with the game board 103 can be a fifth activity (e.g., halfway point), and the interaction with the playhouse 101 can be the final activity. The final activity can correspond to randomly drawing a Level 1 dramatic play card. In one aspect, the final activity must be completed before moving on to Level 2, for example. It should be appreciated that the list of activities, the number of activities, and the order are exemplary and not intended to be limiting. For example, Level 1 of the game can include a first Level 1 activity 605, a second Level 1 activity 610, a third Level 1 activity 615, a fourth Level 1 activity 620, a fifth Level 1 activity 625, a sixth Level 1 activity 630, a seventh Level 1 activity 635, an eighth Level 1 activity 640, a ninth Level 1 activity 645, and a tenth Level 1 activity 650. The first Level 1 activity 605 can correspond to a first worksheet prompting the child to answer the question "How do you feel today?" The second Level 1 activity 610 can correspond to a second worksheet prompting the child to answer the question "What do you look like?" The third Level 1 activity 615 can include a third worksheet prompting the child to answer the question "What are your special qualities?" The fourth Level 1 activity 620 can include a fourth worksheet prompting the child to answer the question "How do you like to spend your time?" The fifth Level 1 activity 625 can include a fifth worksheet prompting the child to answer the question "What activities are involved in this activity?" (e.g., referencing what the child wrote in their response to the fourth Level 1 activity 620), and the fifth Level 1 activity 625 can including placing a business card in the Level 1 area of the game board 103 (e.g., the first area 105). The sixth Level 1 activity 630 can include a sixth worksheet prompting the child to answer the question "What are you good at?" The seventh Level 1 activity 635 can include a seventh worksheet prompting the child to answer the question "What job might be fitting for these traits?" (e.g., referencing what the child wrote in their response to the sixth Level 1 activity 630). The eighth Level 1 activity 640 can include an eighth worksheet prompting the child to answer the question "Who would your colleagues be?" The ninth Level 1 activity 645 can include a ninth worksheet prompting the child to answer the question "What activities would you be doing at this job?" (e.g., referencing what the child wrote in their response to the eighth Level 1 activity 640). The tenth Level 1 activity 650 can correspond to selecting a character dramatic play card (e.g., randomly drawing a character dramatic play card 210 from a deck of character dramatic play cards in the first area 105 of the game board 103) and acting out a role with the playhouse 101 based on the card drawn. After completing the tenth Level 1 activity 650, the players can move to Level 2.

Figure 7:
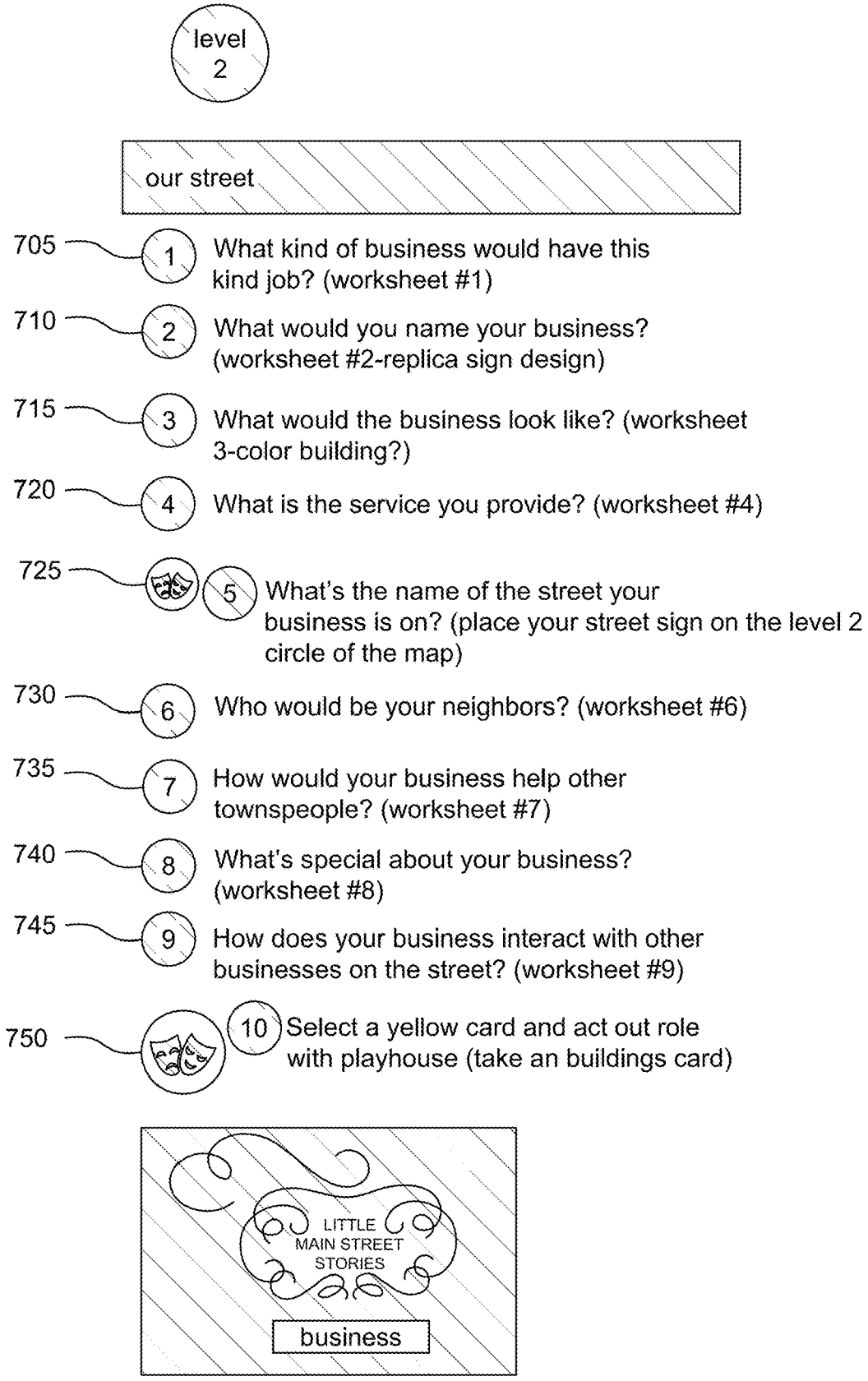
FIG. 7 illustrates exemplary steps to complete Level 2 of the game according to one or more aspects of the disclosed subject matter.

FIG. 7 illustrates exemplary steps to complete Level 2 of the game according to one or more aspects of the disclosed subject matter. For example, the steps can correspond to different activities including a halfway point activity interacting with the game board 103 and the final activity corresponding to randomly drawing a Level 2 dramatic play card. In one aspect, the final activity must be completed before moving on to Level 3. It should be appreciated that the list of activities, the number of activities, and the order are exemplary and not intended to be limiting. For example, Level 2 of the game can include a first Level 2 activity 705, a second Level 2 activity 710, a third Level 2 activity 715, a fourth Level 2 activity 720, a fifth Level 2 activity 725, a sixth Level 2 activity 730, a seventh Level 2 activity 735, an eighth Level 2 activity 740, a ninth Level 2 activity 745, and a tenth Level 2 activity 750. The first Level 2 activity 705 can correspond to a first worksheet prompting the child to answer the question "What kind of business would have this kind of job?" (e.g., referencing what the child wrote in one or more responses to Level 1 activities). The second Level 2 activity 710 can correspond to a second worksheet prompting the child to answer the question "What would you name your business?" The third Level 2 activity 715 can include a third worksheet prompting the child to answer the question "What would the business look like?" The fourth Level 2 activity 720 can include a fourth worksheet prompting the child to answer the question "What is the service you provide?" The fifth Level 2 activity 725 can include a fifth worksheet prompting the child to answer the question "What is the name of the street your business is on?" and can also include placing the street sign in and/or around the perimeter of the Level 2 circle of the game board 103 (e.g., the second area 110). The sixth Level 2 activity 730 can include a sixth worksheet prompting the child to answer the question "Who would be your neighbors?" The seventh Level 2 activity 735 can include a seventh worksheet prompting the child to answer the question "How would your business help other townspeople?" The eighth Level 2 activity 740 can include an eighth worksheet prompting the child to answer the question "What's special about your business?" The ninth Level 2 activity 745 can include a ninth worksheet prompting the child to answer the question "How does your business interact with other businesses on the street?" The tenth Level 2 activity 750 can correspond to selecting a business dramatic play card (e.g., randomly drawing a business dramatic play card 310 from a deck of business dramatic play cards in the second area 110 of the game board 103) and interacting with the playhouse 101 based on the card drawn. After completing the tenth Level 2 activity 750, the players can move to Level 3.

Figure 8:
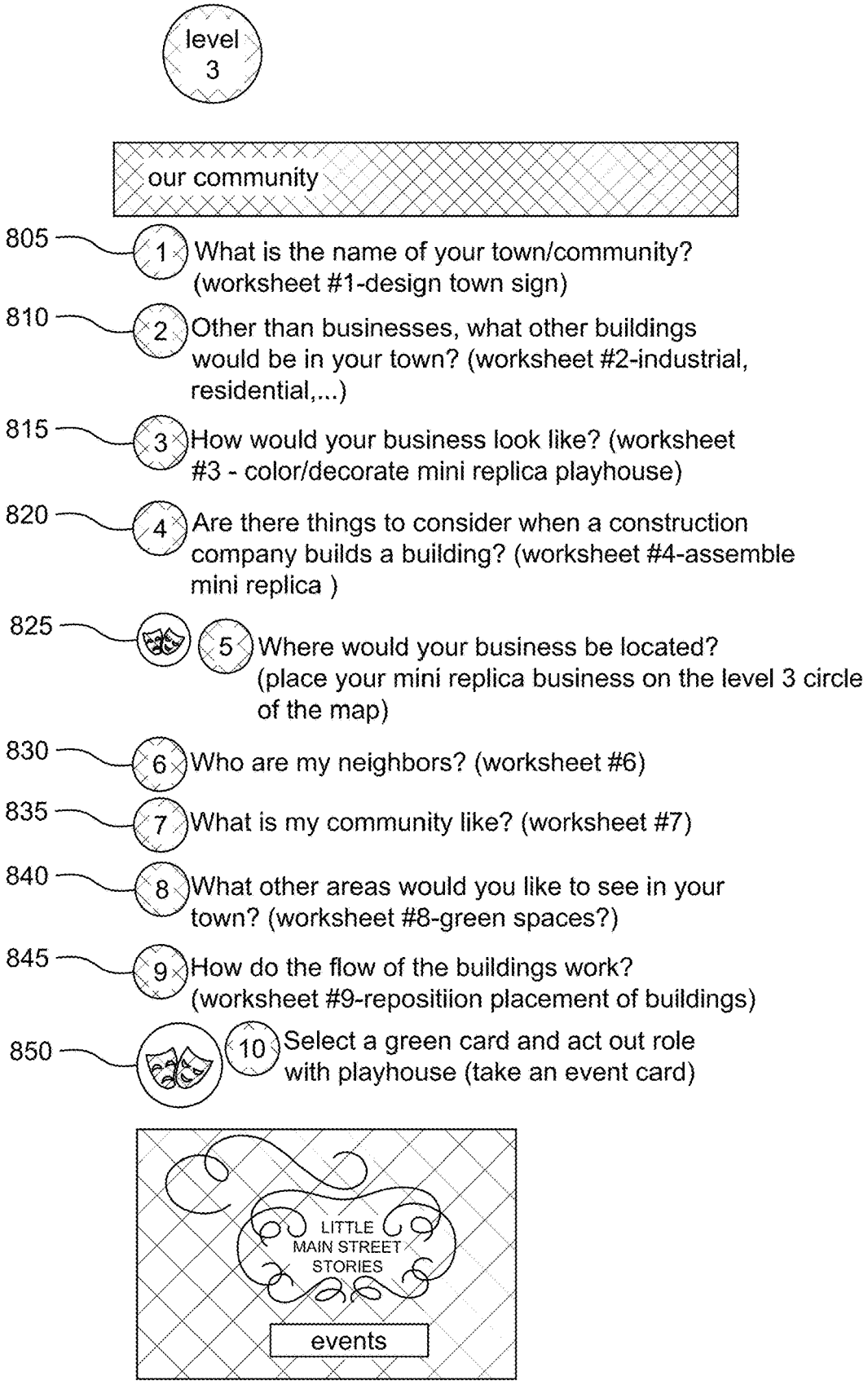
FIG. 8 illustrates exemplary steps to complete Level 3 of the game according to one or more aspects of the disclosed subject matter.

FIG. 8 illustrates exemplary steps to complete Level 3 of the game according to one or more aspects of the disclosed subject matter. For example, the steps can correspond to different activities including a halfway point activity interacting with the game board 103 and the final activity corresponding to randomly drawing a Level 3 dramatic play card. In one aspect, the final activity must be completed before moving on to Level 4. It should be appreciated that the list of activities, the number of activities, and the order are exemplary and not intended to be limiting. For example, Level 3 of the game can include a first Level 3 activity 805, a second Level 3 activity 810, a third Level 3 activity 815, a fourth Level 3 activity 820, a fifth Level 3 activity 825, a sixth Level 3 activity 830, a seventh Level 3 activity 835, an eighth Level 3 activity 840, a ninth Level 3 activity 845, and a tenth Level 3 activity 850. The first Level 3 activity 805 can correspond to a first worksheet prompting the child to answer the question "What is the name of your town/community?" The second Level 3 activity 810 can correspond to a second worksheet prompting the child to answer the question "Other than businesses, what other building would be in your town?" The third Level 3 activity 815 can include a third worksheet prompting the child to answer the question "What would your business look like?" The fourth Level 3 activity 820 can include a fourth worksheet prompting the child to answer the question "Are there things to consider when a construction company builds a building?" The fifth Level 3 activity 825 can include a fifth worksheet prompting the child to answer the question "Where would your business be located?" and to place a mini replica business in and/or around the perimeter of the Level 3 circle of the game board 103 (e.g., the area 115). In one aspect, the mini replica business can correspond to the foldable cuboid playhouse further described herein in FIG. 12. The sixth Level 3 activity 830 can include a sixth worksheet prompting the child to answer the question "Who are my neighbors?" The seventh Level 3 activity 835 can include a seventh worksheet prompting the child to answer the question "What is my community like?" The eighth Level 3 activity 840 can include an eighth worksheet prompting the child to answer the question "What other areas would you like to see in your town?" The ninth Level 3 activity 845 can include a ninth worksheet prompting the child to answer the question "How do the flow of the buildings work?" The tenth Level 3 activity 850 can correspond to selecting an event dramatic play card (e.g., randomly drawing an event dramatic play card 410 from a deck of event dramatic play cards in the third area 115 of the game board 103) and acting out a role with the playhouse 101 based on the drawn card. After completing the tenth Level 3 activity 850, the players can move to Level 4.

Figure 9:
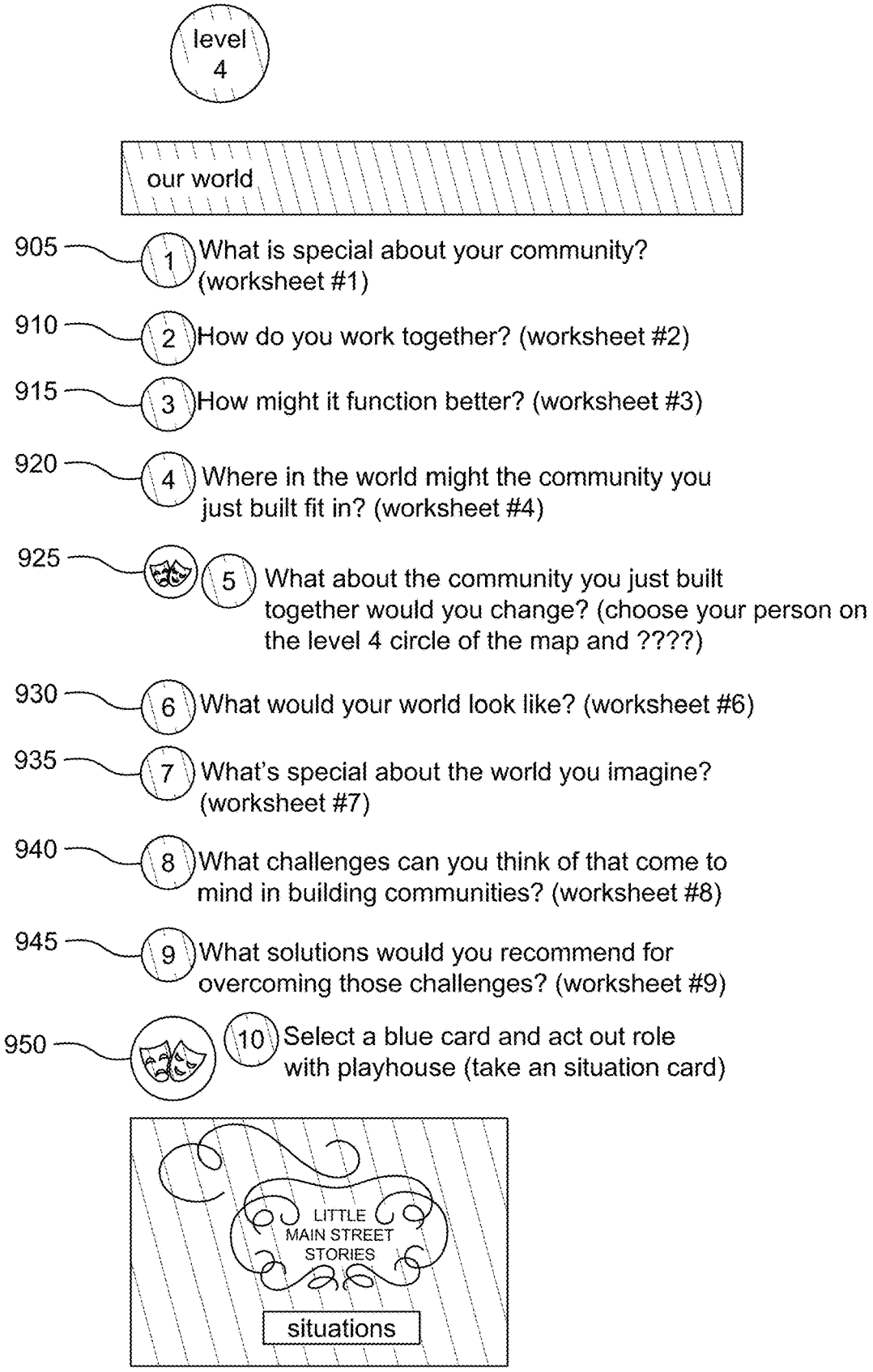
FIG. 9 illustrates exemplary steps to complete Level 4 of the game according to one or more aspects of the disclosed subject matter.

FIG. 9 illustrates exemplary steps to complete Level 4 of the game according to one or more aspects of the disclosed subject matter. For example, the steps can correspond to different activities including a halfway point activity interacting with the game board 103 and the final activity corresponding to randomly drawing a Level 4 dramatic play card. In one aspect, the final activity must be completed before completing the game. It should be appreciated that the list of activities, the number of activities, and the order are exemplary and not intended to be limiting. For example, Level 4 of the game can include a first Level 4 activity 905, a second Level 4 activity 910, a third Level 4 activity 915, a fourth Level 4 activity 920, a fifth Level 4 activity 925, a sixth Level 4 activity 930, a seventh Level 4 activity 935, an eighth Level 4 activity 940, a ninth Level 4 activity 945, and a tenth Level 4 activity 950. The first Level 4 activity 905 can correspond to a first worksheet prompting the child to answer the question "What is special about your community?" The second Level 4 activity 910 can correspond to a second worksheet prompting the child to answer the question "How do you work together?" The third Level 4 activity 915 can include a third worksheet prompting the child to answer the question "How might the community function better?" The fourth Level 4 activity 920 can include a fourth worksheet prompting the child to answer the question "Where in the world might the community you just built fit in?" The fifth Level 4 activity 925 can include a fifth worksheet prompting the child to answer the question "What about the community you just built together would you change?" and to choose another person on the Level 4 circle of the game board 103. The sixth Level 4 activity 930 can include a sixth worksheet prompting the child to answer the question "What would your world look like?" The seventh Level 4 activity 935 can include a seventh worksheet prompting the child to answer the question "What is special about the world you imagine?" The eighth Level 4 activity 940 can include an eighth worksheet prompting the child to answer the question "What challenges can you think of that come to mind in building communities?" The ninth Level 4 activity 945 can include a ninth worksheet prompting the child to answer the question "What solutions would you recommend for overcoming those challenges?" The tenth Level 4 activity 950 can correspond to selecting a situation dramatic play card (e.g., randomly drawing a situation dramatic play card 510 from a deck of situation dramatic play cards in the third area 115 of the game board 103) and acting out a role with the playhouse 101 based on the drawn card. After completing the tenth Level 4 activity 950, the players have completed the game. It should be appreciated that any reference to "randomly" drawing a dramatic play card can correspond to drawing the top card of a deck of cards (e.g., as the cards can be shuffled to promote randomness) or any other way of randomly drawing a card (e.g., choosing one from a fan of cards).

Referring again to the components of the game 100, the playhouse 101 can come in a variety of sizes and styles and can be made so the inside components can be changed easily to enable one playhouse to transform into many different businesses (e.g., customizable). For example, the playhouse 101 can change from a grocery store to a hardware shop with the change of shelving, counter components, and the like. In one aspect, a size of the playhouse 101 can be 4 feet, 8 feet, or 12 feet wide, and each playhouse 101 can be 8 feet tall and 6 feet deep. It should be appreciated that the dimension options of the playhouse 101 are exemplary and can be any dimension that provides a "life size" playhouse for children.

Referring again to the pieces of the imagination kit 102, in one aspect, the game board 103 can be round and have a diameter of 12 feet. Additionally, the game board 103 can have a plurality of circles starting with the individual (Level 1) and moving outward to the street (Level 2), the community (Level 3), and finally, the world (Level 4). The gameboard 103 can be a central element of the game 100 by connecting the activities with the one or more playhouses 101. The gameboard 103 also functions as the area where art creations or mini people and/or building replicas can be placed (e.g., corresponding to the fifth activity of each level in the game) for group discussion and learning. For example, there can be ten activities in each level that are a combination of worksheets, art activities, and dramatic play prompts for interaction with the playhouse 101. The final destination is a connection to a virtual online map (e.g., the virtual online map is represented in FIG. 1B by the online map 190) where photos, stories of lessons learned, and the like can be shared with the community of groups of children who have also completed the game 100.

The art and storytelling activities 145 can include a combination of art and writing activities where different activities can be completed individually or as a group depending on the specific activity. The number of the activity that should be completed can be represented by a circle with a number in it corresponding to that level's color. Additionally, rather than a number, the fifth activity and the tenth activity of each level can be represented by a separate indicator indicating that the instructions involve interaction with the game board 103 or interaction with the playhouse 101. In one aspect, the deck of dramatic play cards in each level can be stored in the circle corresponding to the final activity of that level (e.g., what would be the #10 circle).

The dramatic play cards 150 can include a deck of character cards, a deck of business cards, a deck of event cards, and a deck of situation cards, and each deck corresponds to a specific level. The dramatic play cards 150 prompt dramatic play interaction with the game board 103 and the playhouse 101. The goal of drawing these cards when the rules of the game indicate they should be drawn is to randomly experience one or more of a role, place, time, and challenge you would not have created yourself in order to experience it from another point of view. Each child must complete this activity in order to move to the next level.

The sign 155 for the playhouse 101 can be editable. For example, the sign 155 can have a chalkboard portion. The sign 155 can be a prop to set the tone of the playhouse backdrop to match the story being acted out through the game 100. For example, the child or instructor (e.g., teacher) can erase the previous business name written on the sign 155 and write in the name of the new business and hang it on the playhouse 101.

The mailbox 160 can have a unique address corresponding to the playhouse 101. The address of playhouse 101 can also correspond to a virtual lot on the virtual online street. For example, each purchase of a playhouse 101 can include a virtual lot where photos, stories, reflections, and the like from their game play can be uploaded throughout the game play. The virtual lot can correspond to a digital representation of the unique address and correspond to the location on the virtual street where a digital representation of the playhouse is displayed.

To set up a space to play the game 100, the game board 103 and the corresponding activities and dramatic play cards can serve as a connecting tool use in the physical play space where the playhouse 101 is the backdrop. For example, the children playing the game can sit around the perimeter of the game board 103 to do the activities with easy access and visibility to the playhouses themselves. Some activities are done individually, some involve interacting with the game board 103, and some involve interacting with the playhouse 101. All activities are intended to inspire group discussion, which is an advantage of the game board 103 being circular, for example. In other words, the goal of the imagination kit 102 is to help children (e.g., ages 3-8 years old) start to identify how one person's unique qualities can affect others, and, in turn, the world by way of the questions, interaction with the play space, and their peers in a scene that inspires imagination and creativity.

Referring again to FIG. 1B for a description of playing the game 100, the following game play will refer to a grade school class of students, but the class of students is simply exemplary and other groups of children playing the game 100 can be contemplated. To play the game 100, a class of students can move through the set of activities together at a flexible pace that works for the teacher and curriculum as applicable (e.g., up to a full school year). The class can move through each numbered activity in order as a group—some activities are intended to be performed independently and some involve interaction with other students. In one aspect, the class can only move from one level to the next once they have completed all nine activities in each level in addition to playing the final interactive dramatic play card associated with that level which involves trying the perspective of another.

All activities in the list involve personal reflection and can be done independently by way of art, storytelling, and/or dramatic play activities included in the imagination kit 102. The final activity in each level is where the playhouse interaction takes place and is a prompt for trying on another perspective by way of randomly selecting a card from one of the four sets of dramatic play card decks, respectively based on the level. For example, the child selects a character, business, event, or situation card depending on which level they are on to role play in and/or around the playhouses using the card as a prompt. The sign 155 can be edited to set the scene for the playhouse 101.

An advantage of this ongoing year-long activity is to provide an interactive tool by which teachers can tie-in to existing curriculum as applicable providing an experiential element that connects concepts in a tangible way. By first identifying individual and collective preferences and then experiencing from another's perspective, the game 100 can create empathy and understanding in addition to encouraging the children playing the game 100 to see new ways of doing things. Once the players have made their way through all levels, they are directed back to the online virtual community map (e.g., online map 190) where they can share photos of their town and how their viewpoints might have changed throughout the year. The online map 190 is one long little "Main Street" map that stretches metaphorically around the world by connecting each customer (e.g., school, childcare facility, etc.) to each other. The lines from real to imagined are blurred purposely to create a sense of everything being possible. The players of the game 100 can think out of the box for a better world for all, and the online map 190 advantageously allows groups of players to connect with others in different schools, towns, communities, states, and even different countries around the world.

Figure 10:
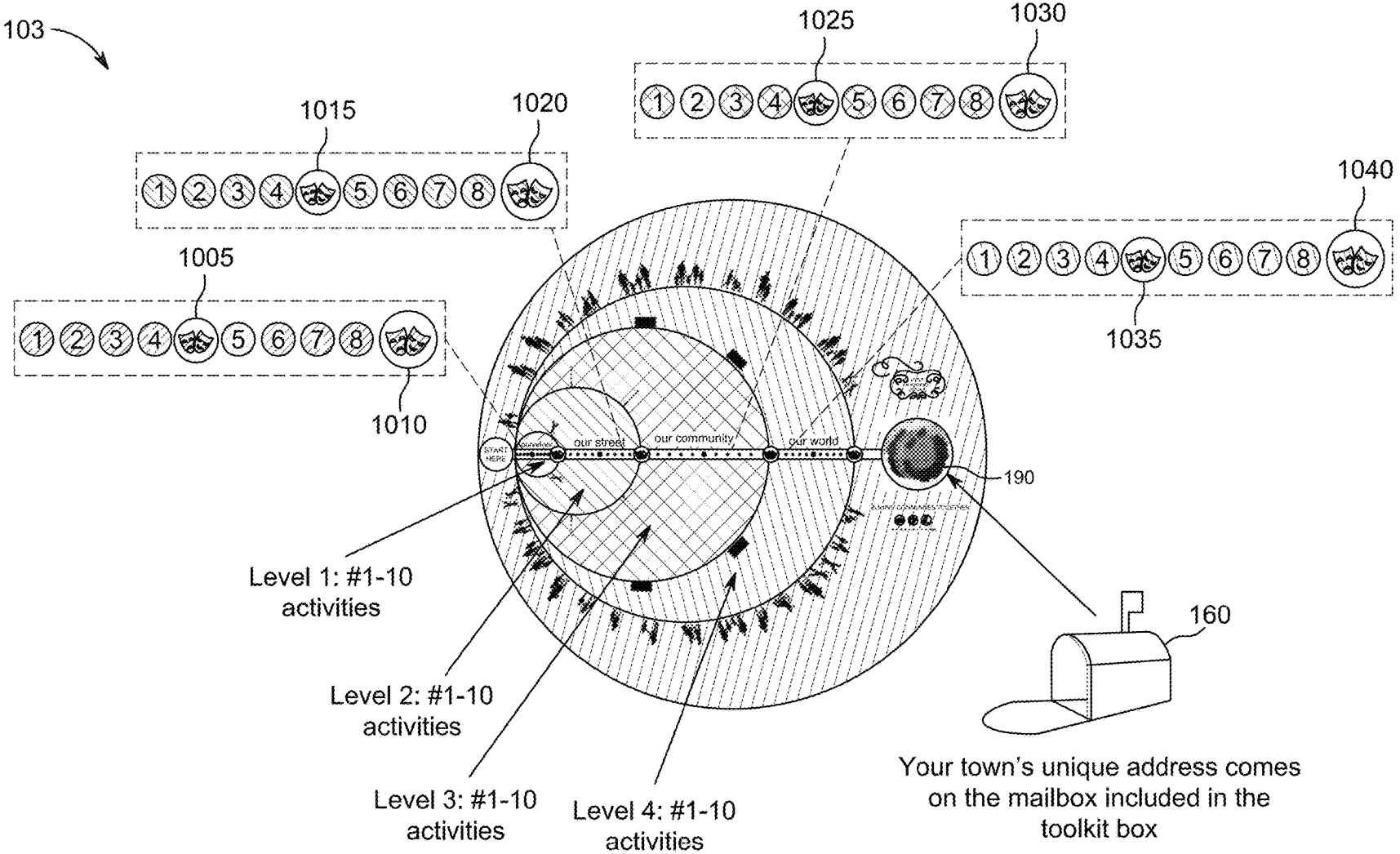
FIG. 10 illustrates the game board highlighting the steps of the game as activities by level according to one or more aspects of the disclosed subject matter.

FIG. 10 illustrates the game board 103 highlighting the steps of the game 100 as activities by level according to one or more aspects of the disclosed subject matter. The illustration of the indicators for the activities by level include a zoomed in view. The Level 1 activities can include ten activities to complete the level (e.g., see FIG. 6 and the corresponding description). Additionally, the Level 1 activities can include a Level 1 fifth activity icon 1005 indicating that the fifth activity includes an interaction with the game board 103. Further, the Level 1 activities can include a Level 1 final activity (i.e., tenth activity) icon 1010 indicating that the final activity includes drawing a dramatic play card corresponding to that level and interacting with the playhouse 101 based on the drawn card. Additionally, in one aspect, the dramatic play card deck corresponding to Level 1 can be stored in the circle that represents the Level 1 final activity icon 1010.

The Level 2 activities can include ten activities to complete the level (e.g., see FIG. 7 and the corresponding description). Additionally, the Level 2 activities can include a Level 2 fifth activity icon 1015 indicating that the fifth activity includes an interaction with the game board 103. Further, the Level 2 activities can include a Level 2 final activity (i.e., tenth activity) icon 1020 indicating that the final activity includes drawing a dramatic play card corresponding to that level and interacting with the playhouse 101 based on the drawn card. Additionally, in one aspect, the dramatic play card deck corresponding to Level 2 can be stored in the circle that represents the Level 2 final activity icon 1020.

Level 3 activities can include ten activities to complete the level (e.g., see FIG. 8 and the corresponding description). Additionally, the Level 3 activities can include a Level 3 fifth activity icon 1025 indicating that the fifth activity includes an interaction with the game board 103. Further, the Level 3 activities can include a Level 3 final activity (i.e., tenth activity) icon 1030 indicating that the final activity includes drawing a dramatic play card corresponding to that level and interacting with the playhouse 101 based on the drawn card. Additionally, in one aspect, the dramatic play card deck corresponding to Level 3 can be stored in the circle that represents the Level 3 final activity icon 1030.

Level 4 activities can include ten activities to complete the level (e.g., see FIG. 9 and the corresponding description). Additionally, the Level 4 activities can include a Level 4 fifth activity icon 1035 indicating that the fifth activity includes an interaction with the game board 103. Further, the Level 4 activities can include a Level 4 final activity (i.e., tenth activity) icon 1040 indicating that the final activity includes drawing a dramatic play card corresponding to that level and interacting with the playhouse 101 based on the drawn card. Additionally, in one aspect, the dramatic play card deck corresponding to Level 4 can be stored in the circle that represents the Level 4 final activity icon 1040.

After completing the final activity in Level 4, the players can move on to the online map 190 that includes access to the virtual street on which the unique address (e.g., listed on the mailbox 160) associated with the playhouse 101 corresponds to a virtual lot.

Figure 11:
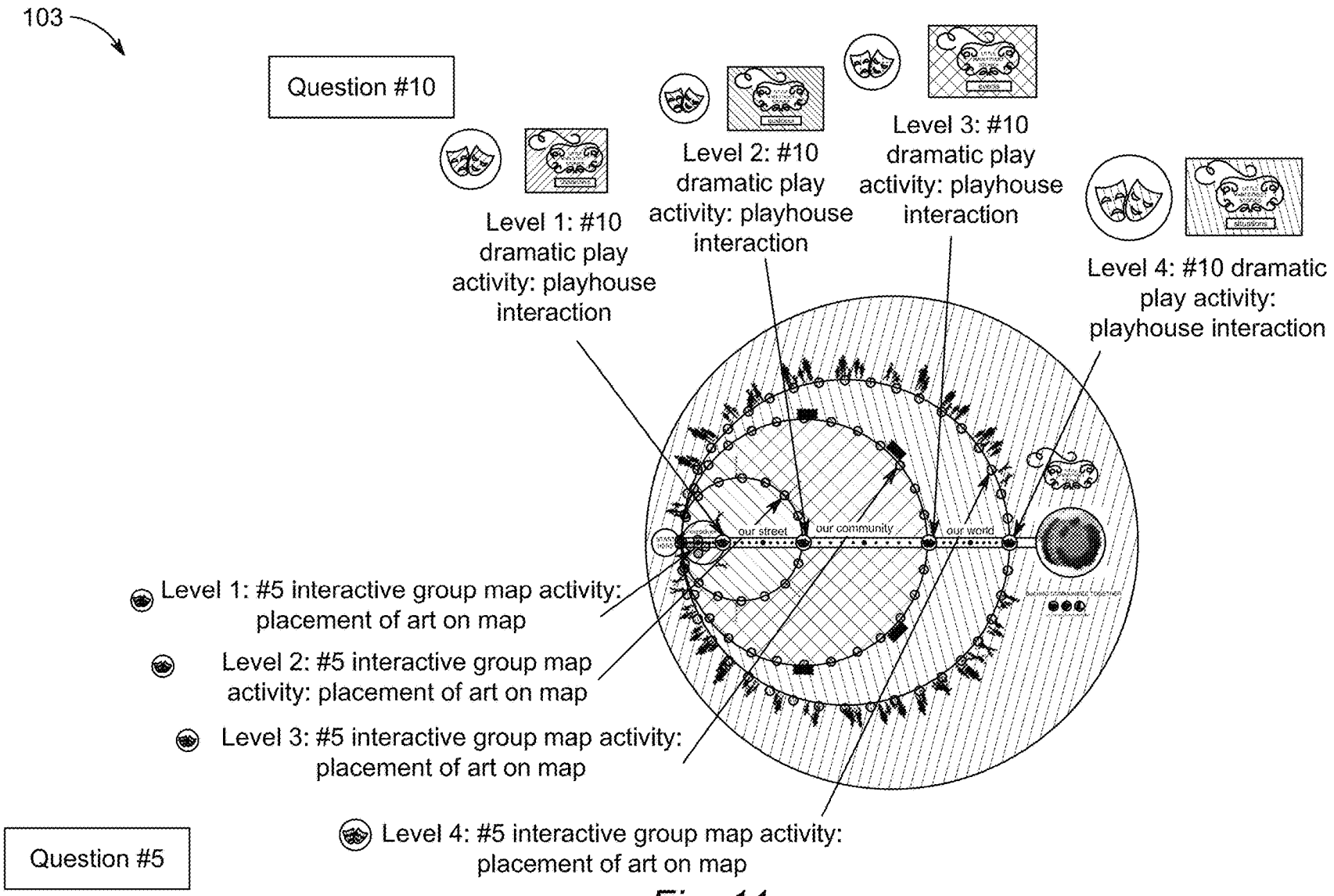
FIG. 11 illustrates how to play a halfway point activity and a final activity for each level of the game according to one or more aspects of the disclosed subject matter.

FIG. 11 illustrates how to play activity numbers five (i.e., halfway point activity) and ten (i.e., final activity) for each level of the game 100 according to one or more aspects of the disclosed subject matter. For example, activities number five and ten for each level involve placement and discussion of the game board 103 or with the playhouse 101. FIG. 11 illustrates an exemplary placement of the activity creations once they are made. For example, the Level 1 fifth activity can correspond to an interactive group activity resulting in placement of art on the game board 103. The art can be placed in the area corresponding to Level 1 on the game board 103. Similarly, as a result of art created in the activity steps, the Level 2 fifth activity can also correspond to placement of art on the game board 103. For example, the Level 2 fifth activity can correspond to placing art on the game board 103 around the perimeter of the circle representing Level 2 of the game 100. Similarly, as a result of art created in the activity steps, the Level 3 fifth activity can also correspond to placement of art on the game board 103. For example, the Level 3 fifth activity can correspond to placing art on the game board 103 around the perimeter of the circle representing Level 3 of the game 100. Similarly, as a result of art created in the activity steps, the Level 4 fifth activity can also correspond to placement of art on the game board 103. For example, the Level 4 fifth activity can correspond to placing art on the game board 103 around the perimeter of the circle representing Level 2 of the game 100. As has been described herein, the final activity of Level 1, Level 2, Level 3, and Level 4 indicates an interaction with the playhouse 101.

Figure 12:
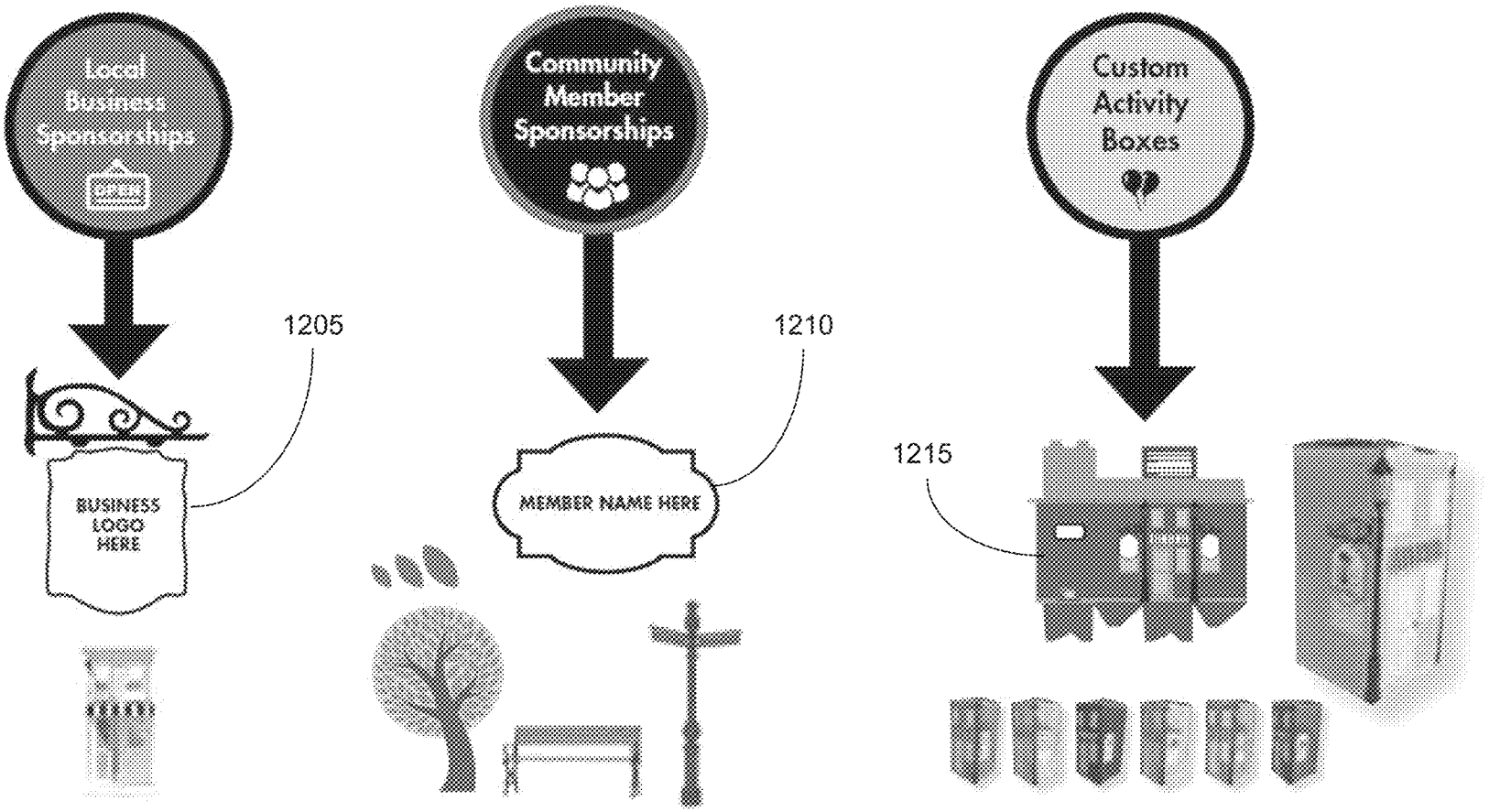
FIG. 12 illustrates an exemplary system for businesses and members of the community to interact with the game according to one or more aspects of the disclosed subject matter.

FIG. 12 illustrates an exemplary system for businesses and members of the community to interact with the game 100 according to one or more aspects of the disclosed subject matter. For example, the game 100 can incorporate businesses and members of the community by creating opportunities for business and members of the community to incorporate their brand or name on one or more game pieces. In one aspect, a local business can sponsor a playhouse 101 to have their business logo on a sign that can be attached to the playhouse 101. For example, a local bank can provide funding for a playhouse 101 for a school and add their name and/or logo to the playhouse 101. In other words, the game 100 advantageously provides local business and/or community members that want to be visible in the education space an opportunity to help provide innovative learning tools to childcare facilities, schools, community centers, camps, and the like (e.g., end users of the game 100). For example, the system for businesses and members of the community to interact with the game 100 can include a branded sign 1205 for the playhouse 101, a display 1210 of a community member's name, and matching customizable mini playhouse replicas 1215 that can be included as game pieces for added play opportunities branded for maximum sponsor visibility.

Figure 13:
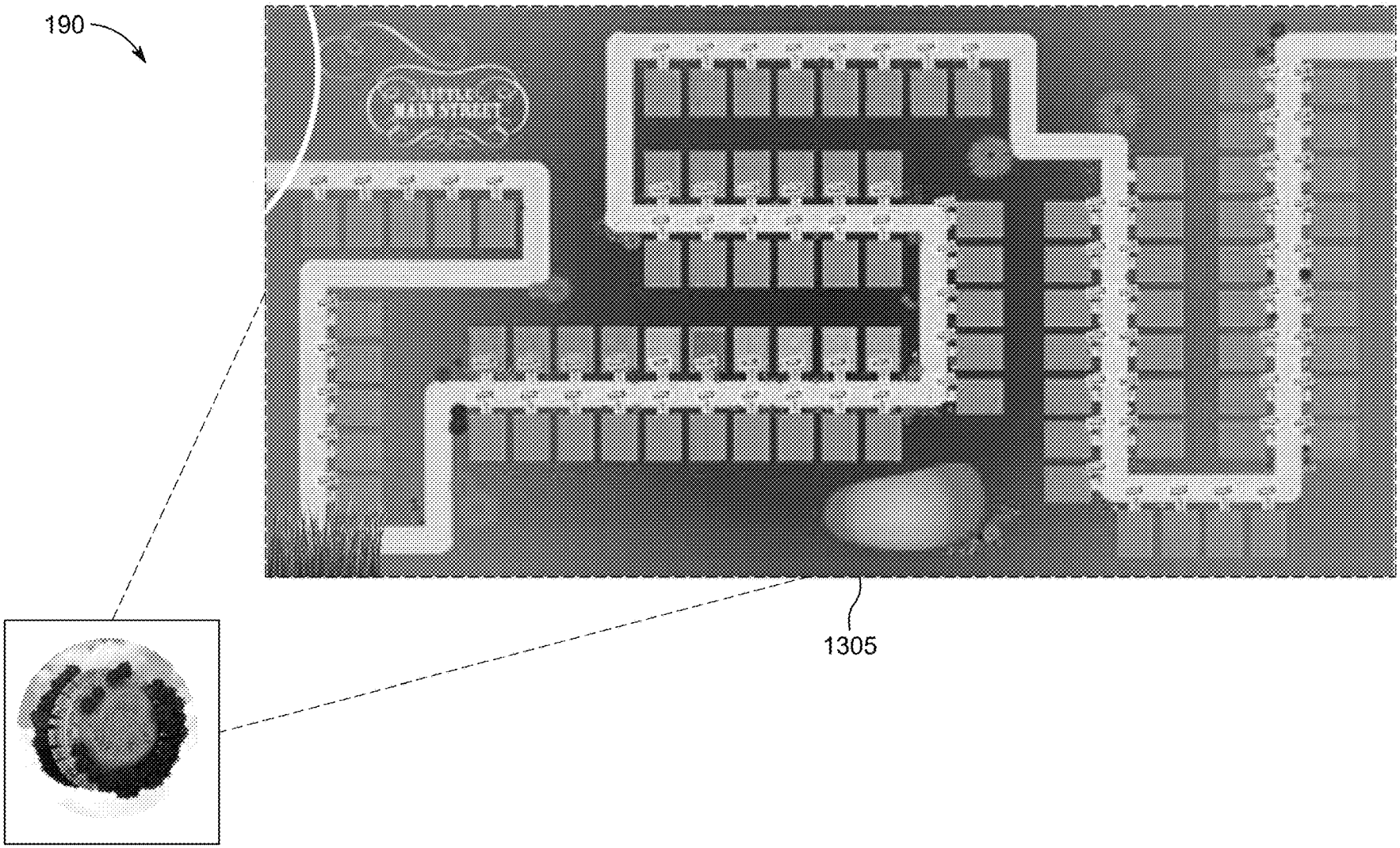
FIG. 13 illustrates an exemplary online map according to one or more aspect of the disclosed subject matter.

FIG. 13 illustrates an exemplary online map (e.g., online map 190) according to one or more aspect of the disclosed subject matter. For example, each playhouse 101 corresponds to a virtual lot on a virtual street 1305 (e.g., one long "Main Street") that metaphorically stretches around the virtual world. In other words, the virtual street 1305 represents an online community of ends users of the game 100 where each end user (e.g., school, community center, camp, etc.) has a virtual lot on the virtual street 1305. Here, in the online map 190, teachers, for example, can upload photos of the playhouse(s) and reflections on lessons learned to share with the online community. This advantageously provides an additional way for children to connect and learn from other ends users of the game. Additionally, the virtual street 1305 advantageously includes (virtual) neighbors that could be from another town, state, or country around the world which further promotes one of the themes of the game which is learning about the perspective of others.

The game 100 provides many advantages including self-discovery, a bird's eye view of the world, flexible and repeatable activities for endless outcomes, and an online community (e.g., online map 190) providing hindsight learning and real-world connection with others. Additionally, the game 100 provides sponsor funding of the playhouses to engage local community participation in exchange for brand exposure, to absorb costs, and create a realistic town backdrop. Additionally, the game 100 is advantageous because it provides play-based learning and naturally lends itself to added activities in existing school subjects including math (e.g., money/economics), social studies (e.g., community government), business (e.g., entrepreneurship/management), English (e.g., story building), art (e.g., creation of buildings/town), history (e.g., time/place), science (e.g., green buildings/spaces/materials), and urban planning and architecture (e.g., industrial, commercial, residential use of space).

Having now described embodiments of the disclosed subject matter, it should be apparent to those skilled in the art that the foregoing is merely illustrative and not limiting, having been presented by way of example only. Thus, although particular configurations have been discussed herein, other configurations can also be employed. Numerous modifications and other embodiments (e.g., combinations, rearrangements, etc.) are enabled by the present disclosure and are within the scope of one of ordinary skill in the art and are contemplated as falling within the scope of the disclosed subject matter and any equivalents thereto. Features of the disclosed embodiments can be combined, rearranged, omitted, etc., within the scope of the invention to produce additional embodiments. Furthermore, certain features may sometimes be used to advantage without a corresponding use of other features. Accordingly, Applicant(s) intend(s) to embrace all such alternatives, modifications, equivalents, and variations that are within the spirit and scope of the disclosed subject matter.

What is claimed is:

1. A game, comprising:

a playhouse;

a game board with a plurality of defined areas, each corresponding to a level of the game, wherein the plurality of defined areas includes a first defined area and each additional area surrounds the first area and radially inward additional areas;

a plurality of activities, wherein a predetermined set of activities corresponds with each level and all activities corresponding with each level is completed before advancing to another level corresponding to a next radially outward area;

a plurality of decks of cards, wherein each deck corresponds with a level and a card from the corresponding deck is drawn during a final activity of a corresponding level, and the final activity of each level includes interaction with the playhouse based on the drawn card; and an online map including a virtual street with a virtual lot, wherein players can access the online map after completing a final activity of the level of a radially outermost area.

2. The game of claim 1, wherein the playhouse is customizable.

3. The game of claim 1, wherein the game ends after completing 4 levels.

4. The game of claim 1, wherein a deck of cards corresponding to a first level corresponding to an innermost area is a deck of character dramatic play cards.

5. The game of claim 1, wherein a deck of cards corresponding to a second level corresponding to a second radially outward area is a deck of business dramatic play cards.

6. The game of claim 1, wherein a deck of cards corresponding to a third level corresponding to a third radially outward area is a deck of event dramatic play cards.

7. The game of claim 1, wherein a deck of cards corresponding to a fourth level corresponding to a fourth radially outward area is a deck of situation dramatic play cards.

8. The game of claim 1, wherein the game is cooperative and all players must complete the final activity of a level before advancing to the next level.

9. The game of claim 1, wherein each level has a halfway point activity including a prompt for interacting with the game board.

10. The game of claim 9, wherein the halfway point activity corresponding to a first level corresponding to an innermost area requires artwork to be placed on the game board in the innermost area.

11. The game of claim 9, wherein the halfway point activity corresponding to a second level corresponding to a second radially outward area requires artwork to be placed on the game board in a second radially outward area.

12. The game of claim 9, wherein the halfway point activity corresponding to a third level corresponding to a third radially outward area requires artwork to be placed on the game board in a third radially outward area.

13. The game of claim 9, wherein the halfway point activity of a final level requires artwork to be placed on the game board in a predetermined location.

14. The game of claim 1, wherein the virtual lot has a unique address corresponding to a location of the playhouse.

15. The game of claim 1, wherein a player can only access the online map after completing the final activity of a predetermined level.

16. The game of claim 1, further comprising an editable sign configured to describe an interaction with the playhouse.

17. The game of claim 1, wherein the plurality of defined areas are the same shape.

18. The game of claim 17, where the plurality of defined shapes are circles.

19. The game of claim 1, further comprising a mailbox having a unique address of the virtual lot on the virtual street.

20. The game of claim 1, wherein 10 of the activities are associated with each level.

* * * * *